US010722910B2

(12) United States Patent
Tapphorn et al.

(10) Patent No.: US 10,722,910 B2
(45) Date of Patent: Jul. 28, 2020

(54) BRUSH-SIEVE POWDER FLUIDIZING APPARATUS FOR NANO-SIZE AND ULTRA FINE POWDERS

(71) Applicants: Ralph M. Tapphorn, Goleta, CA (US); Howard Gabel, Santa Barbara, CA (US)

(72) Inventors: Ralph M. Tapphorn, Goleta, CA (US); Howard Gabel, Santa Barbara, CA (US)

(73) Assignee: Innovative Technology, Inc., Santa Barbara, CA (US)

( * ) Notice: Subject to any disclaimer, the term of this patent is extended or adjusted under 35 U.S.C. 154(b) by 0 days.

(21) Appl. No.: 16/419,534

(22) Filed: May 22, 2019

(65) Prior Publication Data

US 2019/0358656 A1 Nov. 28, 2019

Related U.S. Application Data

(63) Continuation of application No. 62/676,416, filed on May 25, 2018.

(51) Int. Cl.

| | |
|---|---|
| ***B05B 7/14*** | (2006.01) |
| ***B05C 19/06*** | (2006.01) |
| ***B05B 15/25*** | (2018.01) |
| *B65B 1/08* | (2006.01) |

(52) U.S. Cl.

CPC ..... *B05B 7/1445* (2013.01); *B05B 7/1463* (2013.01); *B05B 15/25* (2018.02); *B05C 19/06* (2013.01); *B65B 1/08* (2013.01)

(58) Field of Classification Search

CPC ..... B05B 7/1445; B05B 7/1463; B05B 19/06; B05B 15/25; B65B 1/08

See application file for complete search history.

(56) References Cited

U.S. PATENT DOCUMENTS

| | | | | |
|---|---|---|---|---|
| 3,386,416 A | | 6/1968 | Wirth | |
| 3,570,716 A | * | 3/1971 | Kirsanoff | B05B 7/1445 406/32 |
| 4,071,151 A | * | 1/1978 | Farber | B01J 3/02 202/262 |
| 4,349,323 A | | 9/1982 | Furbish et al. | |

(Continued)

*Primary Examiner* — Nicolas A Arnett

(74) *Attorney, Agent, or Firm* — Greer Burns & Crain Ltd.

(57) ABSTRACT

Powder fluidizing apparatus includes a unitary pressure vessel having a powder compartment and a transfer compartment, a lid on a first open end of the powder compartment and a base on a second end of the unitary pressure vessel, the second end sealing an open end of the transfer compartment. A plate separates the powder compartment from the transfer compartment, the plate being located between the lid and the base. A coupling collar secures a sieve disk packet in an opening in the plate. A tube extends from the transfer compartment to the powder compartment, the tube extending to a location near the lid of the unitary pressure vessel. When the transfer compartment is pressurized with a carrier gas, pressure in the transfer compartment and pressure in the powder compartment are equalized by the tube. The unitary pressure vessel is configured to contain the carrier gas in both the powder compartment and the transfer compartment and simultaneously perform as a reservoir for holding a quantity of powder in the powder compartment.

7 Claims, 6 Drawing Sheets

(56) References Cited

U.S. PATENT DOCUMENTS

| | | | | | |
|---|---|---|---|---|---|
| 4,708,534 | A * | 11/1987 | Gallant | B24C 7/0046 198/757 |
| 5,302,414 | A | 4/1994 | Alkhimov et al. | |
| 5,314,090 | A | 5/1994 | Alexander | |
| 5,654,042 | A * | 8/1997 | Watanabe | B05B 5/1683 427/459 |
| 5,996,855 | A | 12/1999 | Alexander et al. | |
| 6,074,135 | A * | 6/2000 | Tapphorn | B05B 5/047 406/46 |
| 6,098,677 | A * | 8/2000 | Wegman | B65B 1/12 141/256 |
| 6,513,739 | B2 | 2/2003 | Fritz et al. | |
| 6,620,243 | B1 | 9/2003 | Bertellotti et al. | |
| 6,715,640 | B2 | 4/2004 | Tapphorn et al. | |
| 6,915,964 | B2 | 7/2005 | Tapphorn et al. | |
| 7,134,618 | B2 * | 11/2006 | Harutyunyan | B05B 7/1404 239/654 |
| 7,273,075 | B2 | 9/2007 | Tapphorn et al. | |
| 7,348,445 | B2 | 3/2008 | Peters et al. | |
| 7,955,031 | B2 * | 6/2011 | Powell | B65G 47/5145 198/391 |
| 9,505,566 | B2 | 11/2016 | Harvey et al. | |
| 9,919,337 | B1 * | 3/2018 | Decker | B05C 19/00 |
| 10,562,051 | B2 * | 2/2020 | Cotler | B65D 88/66 |
| 2001/0010205 | A1 | 8/2001 | Rodenberger | |

* cited by examiner

BRUSH-SIEVE POWDER FLUIDIZING APPARATUS FOR NANO-SIZE AND ULTRA FINE POWDERS

This is a continuation of Provisional Application Ser. No. 62/676,416 filed May 25, 2018.

INCORPORATION BY REFERENCE

This application incorporates by reference in its entirety and for all purposes the disclosure of U.S. Pat. No. 7,273,075 B2 filed Feb. 7, 2006 and U.S. Pat. No. 6,915,964 filed Apr. 5, 2002.

BACKGROUND

1. Technical Field

The present invention relates to a powder-fluidizing apparatus and process for feeding ultra-fine powders, including nano-size materials, and for feeding powders with a broad particle size distribution, in a uniform manner over a long period of time. The powders are fed into applicators such as coating and spray forming nozzles and guns.

2. Background Art

Several approaches currently exist for fluidizing powders. However, these approaches are designed for fluidizing larger particle sizes (e.g., particles larger than 635 mesh or 20 micrometers) and are not concerned with maintaining a consistent flow over a wide distribution of particle sizes within the fluidized stream.

In conventional powder feeders, ultra-fine powders, including nano-size materials, tend to agglomerate into larger size particles that do not feed uniformly through the feeder and frequently plug the feeder's orifices. Furthermore, conventional powder feeders do not maintain a constant flow over a wide distribution of powder particle sizes. An example is the vibrating powder feeder disclosed in U.S. Pat. No. 6,715,640 issued to Tapphorn and Gabel where ultra-fine powders like WC—Co tend to agglomerate into large clumps. Another example is the fluidized bed powder coating apparatus disclosed in U.S. Pat. No. 6,620,243 issued to Bertellotti et al. where the powder is agitated by gases introduced into the powder bed, causing individual particles to be pushed into a drag out space above the powder bed. This works well to fluidize the powder but it also tends to fluidize only the finer particles, thereby segregating the particle size distribution as it is injected into the fluidizing gas stream.

Several patents disclose flour sifter sieve apparatus that break up agglomerated powders and provide a uniform distribution of particle size, including for example, U.S. Pat. No. 6,513,739 issued to Fritz et al. These patents use wire loops or scrapers to move the powder across the sieve. This works well for soft materials such as baking flour, but metal powders are much more abrasive and will quickly wear out either the sieve or the scraper.

Several patents disclose brush-type devices for feeding powders, including for example, U.S. patent application Pub. No. 20010010205 filed by Rodenberger on Mar. 5, 2001, U.S. Pat. No. 5,996,855 issued to Alexander et al., U.S. Pat. No. 5,314,090 issued to Alexander, and U.S. Pat. No. 4,349,323 issued to Furbish et al. These devices use brushes to collect powder between the bristles and subsequently discharge the powder into the gas stream by brushing across a scraper or another brush. This fluidizes the powder, but it does not break up small agglomerates into individual particles. U.S. Pat. No. 3,386,416 issued to Wirth uses a sieve electrode for electrostatically controlling the dispersion of flocking materials dispensed by adjacent cylindrical rotating brushes. Again, the powder is discharged by the action of the brushes rubbing against each other. The sieve is used to apply an electric charge to the particles and is not used for metering powder and breaking up agglomerated powder particles. The brushes do not come in direct contact with the sieve.

Additionally, U.S. Pat. No. 4,349,323 uses a spiral shaped brush to advance the powder from the hopper to a funnel; the agglomerates then need to be broken with a rapidly rotating blade. This action tends to cause non-uniformity in the powder feed rate.

Recently, U.S. Pat. No. 9,505,566 issued to Harvey et. al. discloses a powder fluidizing method and system for discharging fluidized powder through a sieve positioned at the bottom of a pressurized powder reservoir which requires maintaining differential pressure of about 0.5 bars between the powder reservoir and the powder outlet of the device. Additionally, the invention requires vibrating the entire powder reservoir to feed powder through the sieve. An axially mounted rotating brush identical to the concept disclosed by the prior art of U.S. Pat. No. 7,273,075 is used to sweep powder through the sieve. The limitation of U.S. Pat. No. 9,505,566 is that the metering of powder through the sieve is dependent on the differential pressure between the powder reservoir and the powder outlet of the device and vibration of the entire mass of powder in the powder reservoir. These dependencies can result in non-uniform feeding of powder and a condition in which powder continues to feed through the sieve even when the motor driving the brush is turned off.

None of the aforementioned devices and methods focus on brushing dry powder through a sieve disc for the purpose of both breaking up agglomerated powder particles and simultaneously fluidizing these particles into a carrier gas. More importantly, the prior art of U.S. Pat. No. 7,273,075 does not claim to be able to switch powder feed on or off without substantially perturbing the gas pressure and flow conditions. This feature is important when switching between two or more powder fluidizing units that are configured to feed into a common manifold of the applicator device.

Both U.S. Pat. Nos. 5,996,855 and 5,314,090 teach a method for breaking up and dispensing powders by rotating two adjacent brushes at the funnel port of a hopper. However, neither of these patents discloses a method for brushing dry powders through a sieve disc for de-agglomeration and feeding into a fluidizing carrier gas.

It should be noted that, while specific shortcomings in conventional powder feeders are described above, the subject matter claimed below is not limited to implementations that solve any or all of these shortcomings.

SUMMARY

In keeping with one aspect of the present invention, a powder-fluidizing apparatus and process is particularly applicable to feeding ultra-fine powders, including nano-size materials, and feeding powders with a broad particle size distribution, typically 0.1 micron to 50 micron in size, in a uniform manner over a long period of time. The powders are fed into applicators such as coating and spray forming nozzles and guns. A powder-fluidizing apparatus and process employs novel techniques for feeding the aforementioned types of powders. The improvement over the prior art disclosed in U.S. Pat. No. 7,273,075 B2 is an advanced embodiment using the pressure vessel operating as both a containment vessel for the pressurized carrier gas and a reservoir for the powder. This approach simplifies the manufacturing of the powder-fluidizing apparatus with fewer parts and allows the pressure vessel to simultaneously serve as the shipping or transportation canister for hermetically sealing and storing powder.

Moreover, the present powder-fluidizing apparatus and process feeds the aforementioned types of powders by rotating a three-prong brush, in contact with a removable sieve disc packet, and sweeping the powder through holes in the sieve disc in order to break up agglomerated particles in the powder and control the feed rate of the powder to the applicator.

A further aspect of the invention enables switching the powder feed "off" and "on" without substantially perturbing the gas flow conditions (pressure and gas flow rate) through the pressure vessel. This improvement is made possible by controlling the rotation state ("on/off") of the motor driving the brush in contact with the sieve. When the motor is switched "on" powder loaded into the pressure vessel is uniformly metered through the sieve by the rotating brush in contact with the sieve. Alternatively, when the motor is switched "off" the sieve mesh size is uniquely selected to retain the powder without permitting powder particles to trickle through the sieve. This enables a uniform metering of powder into the carrier gas stream flowing through the pressure vessel to the applicator when the motor driving the rotatable brush is switched "on", and preventing the feed of powder when the motor driving the brush is switched "off."

Feeding powder into the carrier gas stream without significantly perturbing the gas pressure and flow rates is an aspect of the invention. This feature is helpful for depositing coatings with alternating layers of powder materials during buildup or for switching between a grit blast media held in one powder fluidizing unit and a selected powder held in a second powder fluidizing unit for depositing as a coating. The independency of the powder feed and the gas pressure and flow conditions also enables a method for conserving powder or precluding the deposition of powder when articulating the applicator gun/nozzle to different positions on the part or substrate surface being coated by simply switching "off" the motor driving the brush rotation on the sieve.

The powder swept through the holes drops into a fluidizing funnel mounted in the base of the powder-fluidizing apparatus, where being entrained into a carrier gas subsequently fluidizes it. The entrained powder and gas then flow through the funnel and into an outlet fitting attached to a conventional hose for conveying the carrier gas and entrained powder to the applicator. The funnel assembly is constructed of lightweight aluminum alloy and is loosely mounted and constrained with bolts to the base of the pressure vessel so that it is able to be repeatedly shock vibrated or pinged with the armature of a solenoid to avoid powder build-up on the inner surface of the funnel assembly that can break loose and cause pulsing of powder in the carrier gas flow. The motion of the solenoid is driven by a square wave pulse at a frequency to maximize the shock impact to the funnel assembly. Installing rubber washers in the armature cavity can reduce the acoustic noise to levels below 75 dBA. Ultrasonic waves can also be introduced into the funnel assembly with an ultrasonic transducer to break up any agglomerated particles remaining in the powder before it reaches the applicator.

Another aspect of the invention is the use of reactive gases that are capable of treating and thin-film coating powder particles conveyed to a reactor or nozzle mixing chamber when exposed to a high temperature carrier gas within the reactor or nozzle mixing chamber. This approach can be used to activate or passivate powders prior to deposition with an applicator. For example, U.S. Pat. No. 7,348,445 issued to Peters, et al. discloses a method for producing a film or coating on the surface of materials using organoaluminum precursor compounds mixed with other high temperature carrier gases to decompose the organoaluminum precursor compounds and deposit aluminum films on the surface of materials. In one aspect of this invention the improvement would be to inject room-temperature carrier gas (e.g. helium or nitrogen) with an admixture vapor of organoaluminum precursor compound (preferably in gaseous form) for reacting with the powder particles when conveyed to a nozzle mixing chamber. Hot carrier gas (e.g. Helium or Nitrogen) is injected and mixed with the organoaluminum precursor compound in a nozzle mixing chamber to induce decomposition of the organoaluminum precursor compound within the nozzle mixing chamber. Decomposition of the organoaluminum precursor compound produces an aluminum vapor which condenses as a thin film coating of aluminum on each powder particle as it is conveyed through the nozzle mixing chamber and subsequently accelerated through a nozzle for depositing coatings as disclosed in U.S. Pat. No. 6,915,964 issued to Tapphorn and Gabel.

Typical organoaluminum precursor compounds include, but are not limited to dimethylethyl ethylenediamine dimethylaluminum, dimethylethyl ethylenediamine methylaluminum, trimethyl ethylenediamine dimethylaluminum, triethyl ethylenediamine dimethylaluminum, diethylmethyl ethylenediamine dimethylaluminum, dimethylpropyl ethylenediamine dimethylaluminum, and dimethylethyl ethylenediamine diisopropylaluminum.

Such methods for feeding and conveying powders to a reactor or nozzle mixing chamber for high-temperature decomposition of organoaluminum precursor compounds or other reactive vapor materials to thin-film coat the powders prior to deposition with an applicator can be used to enhance corrosion resistance and cohesion strength of impact consolidated coatings.

Similarly, another aspect of the invention permits a process to film coat or passivate powders prior to deposition with an applicator. Here for example, vapor phase polymers can be used to apply a polymer film to metallic, ceramic, and polymer powder particles using gaseous monomers such as ethylene (LDPE, HDPE), tetrafluoroethylene (PTFE), and vinyl chloride (PVC). propylene (PP), methyl methacrylate (PMMA), methyl acrylate (PMA), vinyl acetate (PVA), ethylene vinyl acetate (PEVA) and other types of polymers that are stable in the gaseous phase. The vapor phase monomers are injected into the powder fluidizing unit with an inert carrier gas for conveying the powder particles and gaseous monomers to a reactor or nozzle mixing chamber for thin-film coating of the powder particles by condensation of the gaseous monomers onto the powder particles prior to deposition with an applicator.

It should be noted that this Summary is provided to introduce a selection of concepts, in a simplified form, that are further described below in the Detailed Description of the Preferred Embodiments. This Summary is not intended to identify key features or essential features of the claimed subject matter, nor is it intended to be used as an aid in determining the scope of the claimed subject matter. In addition to the just described benefits, other advantages of the present powder-fluidizing apparatus and process will become apparent from the detailed description which follows hereinafter when taken in conjunction with the drawing figures which accompany it.

DESCRIPTION OF THE DRAWINGS

The specific features, aspects and advantages of the present invention will become better understood with regard to the following description, appended claims, and accompanying drawings where:

DETAILED DESCRIPTION OF THE PREFERRED EMBODIMENTS

In the following description of the preferred embodiments of the present invention reference is made to the accompanying drawings, which form a part hereof, and in which are shown, by way of illustration, specific embodiments in which the invention may be practiced. It is understood that other embodiments may be utilize and structural changes may be made without departing form the scope of the present invention.

In general, the present invention relates to a powder-fluidizing apparatus and process for feeding ultra-fine powders, including nano-size materials, and for feeding powders with a broad particle size distribution, in a uniform manner over a long period of time. The powders are fed into applicators such as coating and spray forming nozzles and guns. The present invention is embodied in a powder-fluidizing apparatus and process that employ novel techniques for feeding the aforementioned types of powders. These techniques will now be described in detail.

Figure 1:
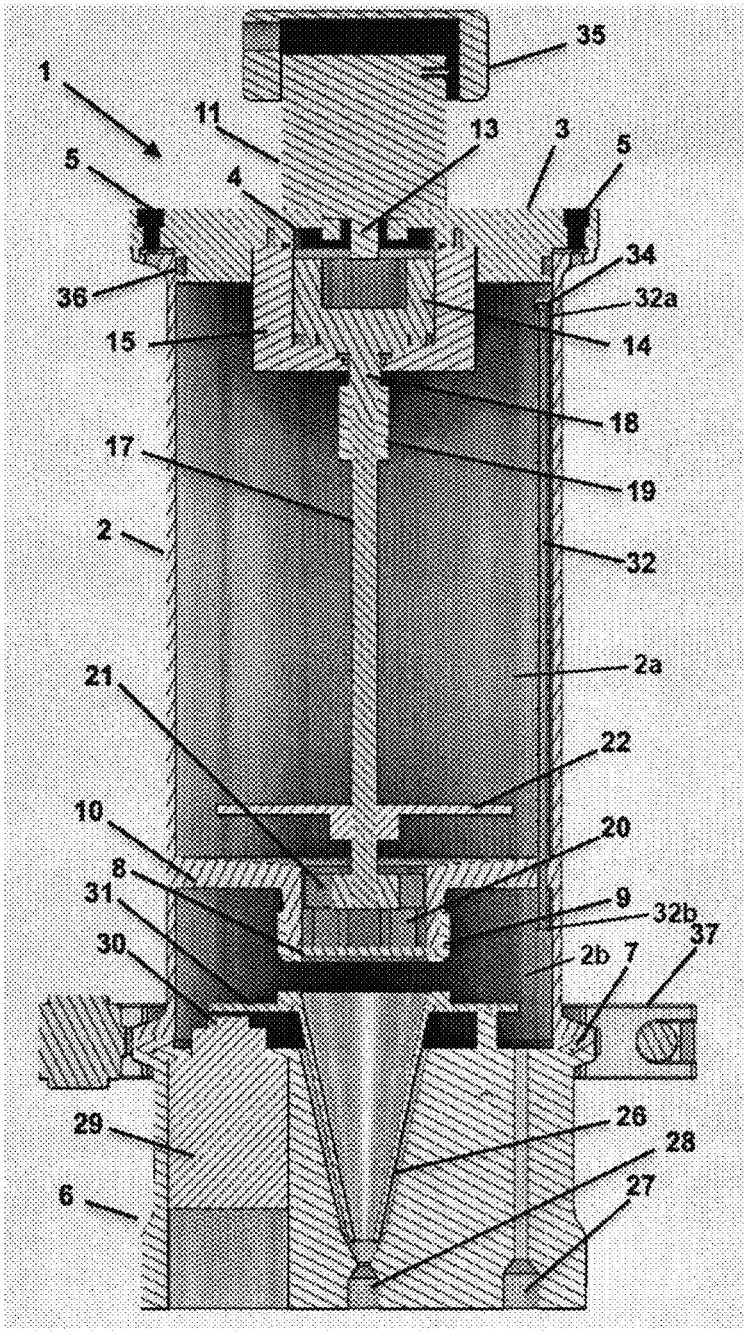
FIG. 1 shows an exemplary cross-section view of a powder-fluidizing apparatus according to the present invention.

FIG. 1 shows an exemplary cross-section view of a summary embodiment of the present powder-fluidizing apparatus 1.

The powder-fluidizing apparatus 1 includes a unitary pressure vessel 2, which comprises a lid 3 coupled at an open end of the cylindrical tube of the pressure vessel 2 with o-ring seal 36 using a plurality of screw bolts 5. The pressure vessel 2 is mounted on a base 6 at the other end of the pressure vessel 2. The base 6 is sealed with lower gasket 7, and is secured to the base with clamp 37, which permits the pressure housing 2 to be pressurized with a carrier gas. An improvement to this invention over the prior art of U.S. Pat. No. 7,273,075 is the dual purpose of the pressure vessel 2 to incorporate the pressurized containment of carrier gas and to simultaneously perform as a reservoir or canister for holding a quantity of powder. As seen in FIG. 1, the pressure vessel 2 has a powder compartment 2*a* that initially stores the powder, and a transfer compartment 2*b* through which the powder passes.

Internal to the pressure vessel 2 is a plate 10 located between the lid 3 and the base 6. The plate 10 separates the powder compartment 2*a* from the transfer compartment 2*b*.

A sieve disc packet 8 is attached to an outlet on the bottom of the powder compartment 2*a* of the pressure vessel 2 with a coupling collar 9 screwed onto the plate 10. One functional purpose for the sieve disc packet 8 is to retain the bulk powder in pressure vessel 2 without gravity flow of the powder through holes in the sieve disc packet 8. Two other functional purposes for the sieve disc packet 8 are to breakup agglomerated particles in the powder, and to control the feed rate of the powder, both of which are discussed in detail below.

Referring again to FIG. 1, a motor 11 is mounted to the lid 3 with the motor drive shaft 13 coupled to a gearhead 14, mounted inside the pressure vessel 2 above the powder. A cap 35 mounted on top of the motor 11 provides a means for securing the motor wires with a connector to a motor control module (not shown). Gasket 4 is used to seal the motor drive shaft 13 and the interface of gearhead 14 to the lid 3 of the pressure vessel 2. The gearhead 14 is clamped to the lid 3 with the cup fixture 15 using a plurality of screws 16 (not shown). Shaft 17 is coupled to the gearhead drive shaft 18 via a conventional shaft coupler 19.

The electrical wires associated with the supply of power and control of the motor 11 are not shown. The motor 11 with gearhead 14 provides rotation of a brush 20, which is attached to the gearhead 14 via a drive shaft 17. Drive shaft 17 is notched at the end to accommodate a pin (not shown) installed in the bushing 21 of the brush 20 to provide a means of rotating the brush 20 with drive shaft 17. Additionally, this approach allows the brush 20 installed in the bushing 21 to be removed from drive shaft 17 for filling the pressure vessel 2 with powder or cleaning the pressure vessel 2 with compressed air or solvents.

Figure 2:
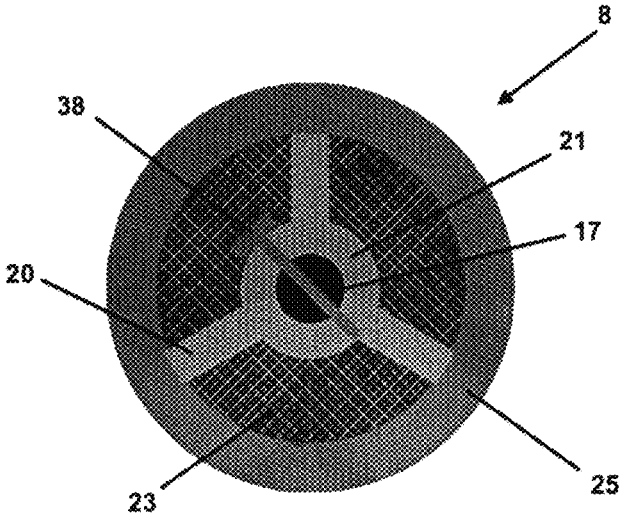
FIG. 2 shows an exemplary plan view of one type of sieve disc packet for the apparatus of FIG. 1 that utilizes a wire cloth.
Figure 3:
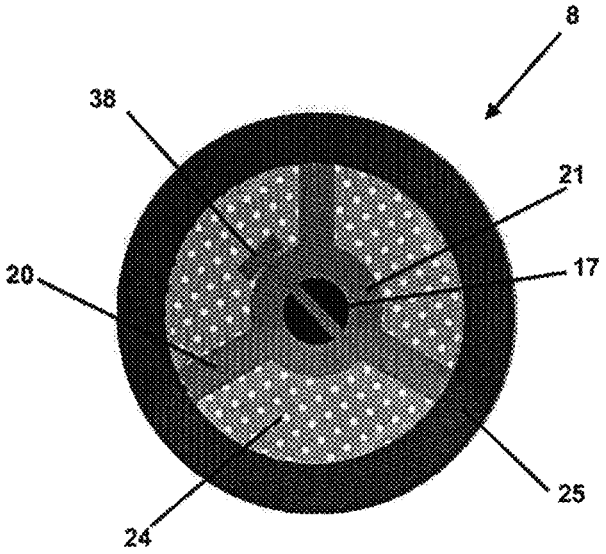
FIG. 3 shows an exemplary plan view of another type of sieve disc packet for the apparatus of FIG. 1 that utilizes a perforated disc.

Referring yet again to FIG. 1, the brush 20 is designed to be periodically replaced by removing the three-prong bushing 21 with installed bristles from the distal end of shaft 17 having a notch (not shown) for accepting pin 38 installed in the three-prong bushing 21 (see FIGS. 2 & 3). Preloading of the brush 20 bristles onto the sieve disc packet 8 is accomplished by changing the length of shaft 17 by adjusting the coupling tolerance of the coupler 19. The drive shaft 17 additionally has optional vanes 22 located in various places on the shaft 17 which protrude from the shaft 17 inside the pressure vessel 2 at various depths into the powder for stirring the powder and permitting gravitational feeding down through the sieve disc packet 8 coupled to the outlet plate 10. The rotating brush 20, in contact with the sieve disc packet 8, feeds the powder and breaks up agglomerated particles in the powder by sweeping the powder through holes in the sieve disc packet 8. The feed rate of the powder is controlled by controlling the speed of the motor 11 with gearhead 14, which in turn controls the rotation speed of the drive shaft 17 and brush 20. Increasing the rotation speed of the brush 20 increases the feed rate of the powder, while decreasing the rotation speed of the brush 20 decreases the feed rate of the powder. The feed rate of the powder can be precisely controlled using a variable speed DC, servo or stepper motor.

Still referring to FIG. 1, the sieve disc packet 8 is mounted into plate 10 with coupling nut 9, which tightens or locks the sieve disc packet 8 in place to prevent movement of the sieve disc packet 8 during rotation of brush 20. The coupling collar 9 permits removal of the sieve disc packet 8 and installation of an alternate sieve disc packet 8. This ability to exchange sieve disc packets 8 permits a new sieve disc packet 8 to be installed into the apparatus 1 when the existing sieve disc packet 8 becomes worn.

Various sieve disc packet 8 structures and configurations can be selected for optimum feeding of different types of powders. Example variations in sieve disc packet 8 structures and configurations include variations in hole shape, hole size, hole pattern, and number of holes, among others. The sieve disc packet 8 could be constructed from a wire cloth with various mesh sizes, or from a disc with discrete holes perforated into the disc. By way of further example but not limitation, FIG. 2 shows an exemplary plan and cross-sectional view of one possible type of sieve disc packet 8 that utilizes a wire cloth 23, where the mesh pattern in the wire cloth 23 provides the holes for dispensing the powder. FIG. 3 shows an exemplary plan view of another possible type of sieve disc packet 8 that utilizes a perforated disc 24 where the perforations in the disc provide the holes for dispensing the powder. An exemplary construction technique for manufacturing these sieve disc packets 8 is implemented with wire cloth 23 or the perforated disc 24 captured in a ring-clamp washer 25 (See FIGS. 2 & 3) to provide structural integrity. For sieve disc packets 8 implemented with a finer wire cloth 23, it is necessary to use a coarse mesh wire cloth 23 captured in the ring-clamp washer 25 below the finer wire cloth 23 to provide mechanical support and preclude distortion of the sieve disc packet 8 under loads applied by the brush 20 in contact with the sieve disc packet 8.

The wire cloth 23 can be integrated into a sieve disc packet 8 by clamping the circumferential edge of the wire cloth 23 or combination of fine wire cloth and coarse wire cloth 23 with an open "C" shaped cylindrical ring that is mechanically pinched to capture the wire cloth 23 within a final sieve disc packet 8 packet.

Also internal to the pressure vessel 2 is a fluidizing funnel 26, located in the lower chamber 2*b* underneath the outlet of plate 10 at a distance from the bottom side of the sieve disc packet. The funnel 26 collects the powder after it is swept from the upper chamber 2*b* through the holes in the sieve disc packet 8 and then drops from the bottom of the sieve disc packet 8 via gravitational force.

A carrier gas is injected into an inlet port 27 on the base 6. Options for the carrier gas include, but are not limited to, helium, nitrogen, argon, air, or mixtures thereof. The fluidizing funnel 26 is located at a distance from the bottom of the sieve disc packet 8 in order to allow a portion of the gas to flow into a gap between the bottom of the sieve disc packet 8 and the top of the fluidizing funnel 26. This gas flow fluidizes the powder by entraining the powder as it drops from the bottom of the sieve disc packet 8 in the carrier gas flowing through outlet port 28 on the base 6. The entrained powder is subsequently pneumatically conveyed by the carrier gas, which continues to flow through the fluidizing funnel 26, through an outlet on the fluidizing funnel 26, and then into an outlet port 28 on the base 6. The remaining portion of the gas flows into a gap between the outlet on the fluidizing funnel 26 and the inlet of port 28 on the base 6, where it mixes with the aforementioned entrained powder and gas flowing out of the outlet on the fluidizing funnel 26. The entrained powder and gas are finally discharged from the pressure vessel 2 through the outlet port 28 into a hose (not shown) attached to the outlet port 28, which carries the entrained powder and gas to an applicator. The pressure and flow rate of the carrier gas are controlled outside the apparatus 1 by conventional gas regulators, flowmeters and metering valves (none of which are shown). The outlet port 28 of the apparatus 1 may also have an in-line valve such as a ball valve (not shown) for retaining gas pressure in the pressure housing whenever the applicator is idle or shutdown.

One aspect of the present apparatus and process is that the carrier gas flows both into a gap at the top of the fluidizing funnel 26, as well as into a gap at the bottom of the fluidizing funnel 26 located between the outlet of the fluidizing funnel 26 and where this outlet enters the outlet port 28 on the base 6. If this feature was not present and all the gas flowed only into the gap at the top of the fluidizing funnel 26 and then into the top of the fluidizing funnel 26, then a turbulent flow could result causing the powder to escape and fume into the area outside of the fluidizing funnel 26. Similarly, if this feature was not present and all the gas flowed only into the gap at the bottom of the fluidizing funnel 26 and then into the outlet port 28 on the base 6, the powder might not be uniformly entrained into the gas flow. Another aspect of the present apparatus and process is that the carrier gas flow rate is independent of the powder feed rate, which is needed for many metallic spray processes including Kinetic Metallization as enabled by U.S. Pat. No. 6,915,964 issued to Tapphorn and Gabel.

In order to equalize gas pressure between the pressure vessel 2 and the cavity below the plate 10 a small diameter tube 32 with a sintered metal filter 34 is installed in plate 10. The tube 32 has an open lower end 32*b* in the transfer compartment 2*b*, and an open upper end 32*a* in the powder compartment 2*a*. The upper end 32 is near but spaced from the lid 3. The tube 32 allows the gas pressure in the transfer compartment chamber 2*b* and the powder compartment 2*a* to equalize. This approach also precludes fluidization and movement of the powder in the pressure vessel 2 when the pressure vessel is filled or emptied with gas.

An electromechanical solenoid 29 is mounted in base 6, so that pulsing the armature 30 electromechanical solenoid 29 with a prescribed square-wave current signal applied to the coil of the electromechanical solenoid 29 results in motion of the armature 30 which strikes (pings) the mounting plate 31 of the fluidizing funnel 26 to induce a shock vibration into the fluidizing funnel 26 to avoid powder build-up on the surface, which can result in non-uniform powder feeding as accumulated powder breaks lose in clumps from the fluidizing funnel 26 surface and is entrained into the carrier gas as it passes through the fluidizing funnel 26. The fluidizing funnel 26 is constructed of lightweight aluminum alloy and is loosely mounted and constrained by plurality of bolts attached to base 6.

An ultrasonic wave transducer (not shown) attached to the mounting plate 31 of the fluidizing funnel 26 serves to further break up any agglomerated particles remaining in the entrained powder as it flows through the fluidizing funnel 26. Electrical power is supplied to the electromechanical solenoid 29 or ultrasonic wave transducer via pressure sealed electrical feedthroughs (not shown).

Referring yet again to FIG. 1, the pressure vessel 2 clamped to base 6 can be mounted onto a load cell mechanism (not shown) for measuring the residual powder in the pressure vessel 2, and for computing the powder mass flow rate of the powder that is discharged from the apparatus 1. The load cell mechanism can include either a single load cell or multiple load cells mounted to the base 6 and fastened to a cabinet tabletop (not shown).

Referring yet again to FIG. 1, a heater band (not shown) can be mounted to the outside of the pressure vessel 2 in order to dry the bulk powder before it is brushed through the sieve disc packet 8. Drying the powder at prescribed temperatures (by way of example, in excess of 130° F.) aids in breaking up agglomerated particles in the powder as the powder is swept through the holes in the sieve disc packet 8. This also aids in preventing the sieve disc packet 8 from possibly becoming plugged with a consolidated paste of the powder as it is brushed across the sieve disc packet 8.

Referring yet again to FIG. 1, the brush 20 and sieve disc packet 8 could be constructed from various materials. The brush 20 and sieve disc packet 8 may be constructed from materials that are a constituent of the powder to prevent any undesirable cross contamination of the powder from occurring during wear of the brush 20 and sieve disc packet 8.

Referring yet again to FIG. 1, removable-clamp 37 is used to secure the pressure vessel 2 to the base 6, permitting pressure vessel 2 to be removed from the base 6 for various different reasons including but not limited to, filling with powder, maintaining, cleaning and servicing the apparatus 1, or exchanging sieve disc packets 8 as discussed above. The powder is not stored in a separate vessel, as in conventional devices.

Referring now to FIG. 2 and FIG. 3, a removable brush 20 has a three-prong configuration. Various types of materials can be used for bristles (not shown in FIGS. 2 &3) of the brush 20 in order to be compatible with the types of powders being loaded in the apparatus 1. Density and stiffness of the bristles installed into the three-prong bushing 21 can also be designed for optimum feeding conditions of the powder. By mounting the brush 20 with a pin 38 through the center of the three-prong bushing 21, a notch (not shown) in the distal end of shaft 17 fits over the pin 38 to permit rotation to the brush 20. Mechanical loading of the brush 20 can be set to deflect the bristles under tension when mounted onto pin 38 to maintain a consistent and uniform powder flow through the sieve plate 8.

FIG. 2 shows wire cloth 23 captured in the ring-clamp washer 25. Referring to FIG. 3, the sieve plate 8 can be used with a perforated disc 24 having a distribution of holes installed in the perforated disc 24 captured in the ring-clamp washer 25. This embodiment may be used to feed coarse powder materials that would otherwise clog a fine mesh sieve or screen.

Figure 4A:
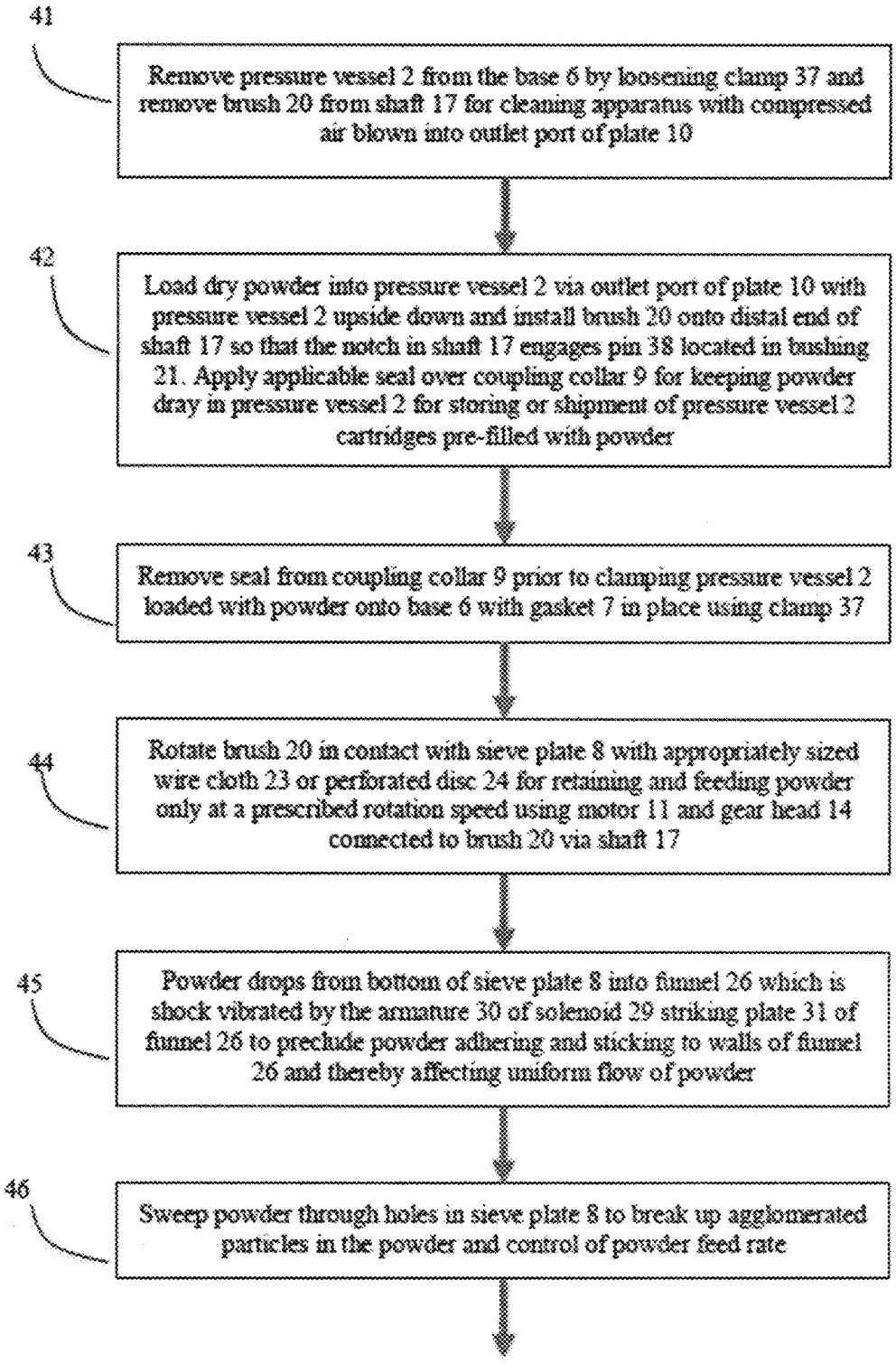
FIGS. 4*a* and 4*b* show an exemplary flow diagram of a powder-fluidizing process using the apparatus of FIG. 1.
Figure 4B:
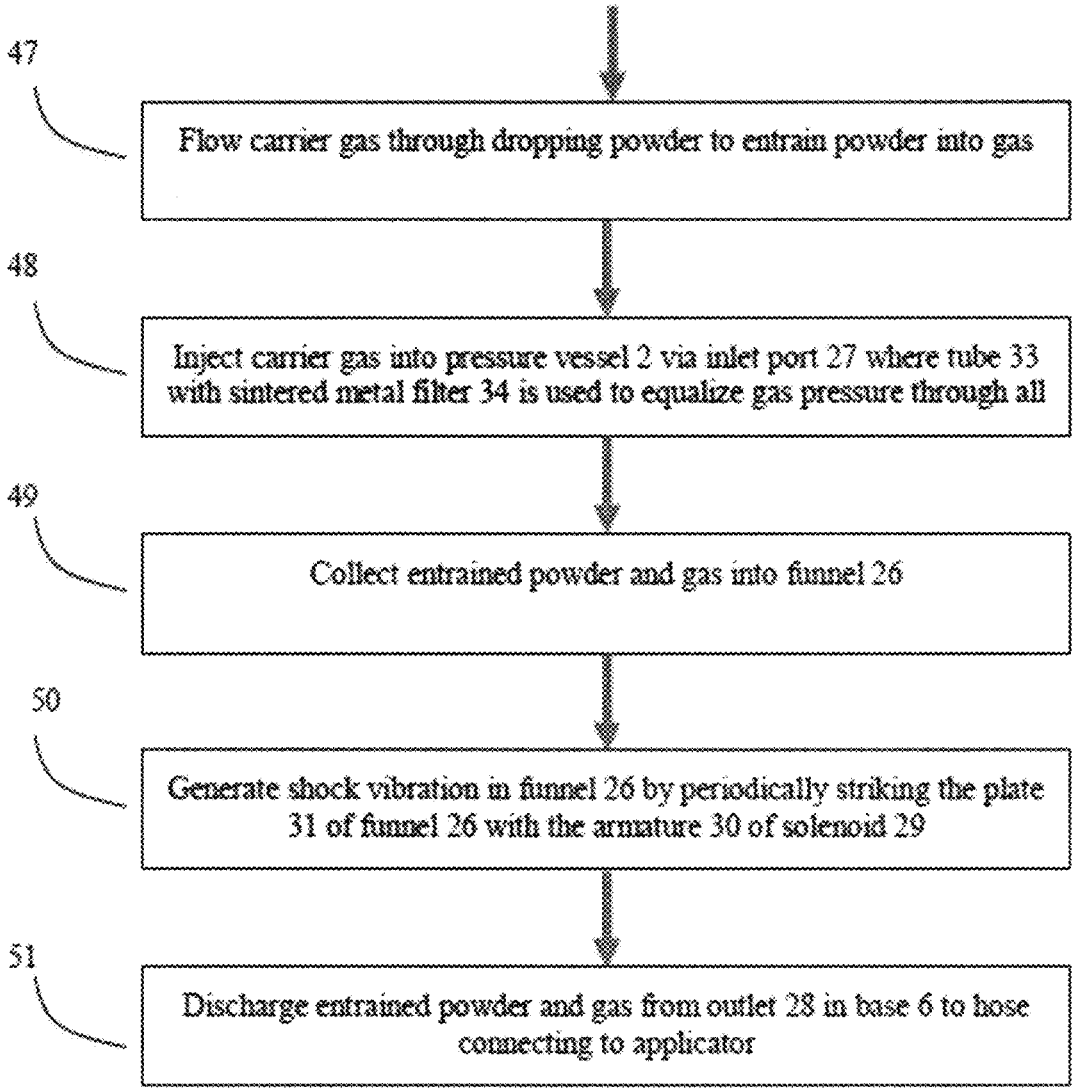

FIGS. 4*a* and 4*b* show an exemplary flow diagram of the present powder-fluidizing process for feeding bulk powder into an applicator. The process 40 follows the steps 41-51 described in the flow chart.

In step 41, pressure vessel 2 is removed from the base 6 by loosening clamp 37 and removing brush 20 from the shaft 17 for cleaning purposes with compressed air blown into the outlet port of plate 10.

In step 42, dry power is loaded into pressure vessel 2 via the outlet port of plate 10 with pressure vessel 2 oriented up-side-down. A brush 20 is installed onto the distal end of shaft 17 so that the notch in the shaft 17 engages the pin 38 located in bushing 21. A seal is applied over the coupling collar 9 for keeping the powder dry in the pressure vessel 2, for storing or shipment of the pressure vessel 2 cartridges prefilled with powder.

In step 43, the seal is removed from the coupling collar 9 prior to clamping the pressure vessel 2 (loaded with powder) onto base 6 with the gasket 7 in place, using clamp 37.

In step 44 the brush 20 is rotated in contact with the sieve plate 8, which has appropriately sized wire cloth 23 or perforated disc 24. The sieve plate 8 retains and feeds power only at a prescribed rotation speed using the motor 11 and the gear head 14 connected the brush 20 via the shaft 17.

In step 45, powder drops from the bottom of the sieve plate 8 into the funnel 26, which is shock vibrated by the armature 30 of solenoid 29 by striking the plate 31 of the funnel 26. These vibrations preclude powder from adhering and sticking to the walls of the funnel 26, resulting in a uniform flow of powder.

In step 46, powder is swept through holes in the sieve plate 8 to break up agglomerated particles in the powder and control the powder feed rate.

In step 47, carrier gas flows through the dropping powder to entrain the powder into gas.

In step 48, carrier gas is injected into the pressure vessel 2 via the inlet port 27. Tube 33 with sintered metal filter 34 is used to equalize gas pressure throughout the entire pressure vessel 2.

In step 49, entrained powder and gas is collected in funnel 26.

In step 50, shock vibration is generated in funnel 26 by periodically striking the plate 31 of funnel 26 with the armature 30 of solenoid 29.

In step 51, entrained powder and gas are discharged from the outlet 28 and base 6 to a hose connecting to an applicator.

It is anticipated that the present powder-fluidizing apparatus and process will be used by Kinetic Metallization systems such as U.S. Pat. No. 6,915,964 issued to Tapphorn and Gabel. "Cold Spray" systems disclosed by Alkhimov, et al. in U.S. Pat. No. 5,302,414 and various types of thermal and plasma spray guns may also benefit from the features of the invention. In addition, the present powder-fluidizing apparatus and process could find applications in dry powder coating and dispersion devices.

The present powder-fluidizing apparatus and process were tested using a WC—Co17% powder having an average particle size in the 1-5 micrometer range. Typically, this powder agglomerates such that it forms a semi-solid paste with a high degree of particle agglomeration. By drying the WC—Co17% powder in an inert gas, the apparatus was able to uniformly feed the powder into a Kinetic Metallization nozzle as disclosed in U.S. Pat. No. 6,915,964 issued to Tapphorn and Gabel. The feed rates for the WC—Co17% powder was adjusted from 10-30 gram/minute by adjusting the rotating speed of the rotating brush 20 from 5 to 20 rpm with selection of a 40-mesh sieve. No build-up of fluidized powder on the surface of the fluidizing funnel 26 occurred with carrier gas flow rates of 5-10 SCFM helium while using the electromechanical solenoid 29 to shock vibrate the powder fluidizing funnel 26. For this particular powder the sieve disc packet 8 was fabricated using a 40-mesh stainless steel wire cloth 23. The rotating brush 20 was fabricated using stainless steel bristles installed in a nylon bushing 21.

The present powder-fluidizing apparatus 1 and process were also tested using a blend of aluminum and chromium (Al-Trans®) powder having an average particle size in the 1-45 micrometer range. This powder does not exhibit agglomerating characteristics and represents an example of using the powder-fluidizing apparatus 1 to feed free flowing powders. In this particular example Al-Trans® powder was loaded into the pressure vessel, and a 60-mesh stainless steel wire cloth 23 was also selected as the sieve disc packet 8. The rotation speed for the rotating brush 20 was set to approximately 10 rpm to yield a desirable feed rate of 30 grams/min for uniformly feeding Al50%-Cr50% (Al-Trans®) powder into the Kinetic Metallization system disclosed in U.S. Pat. No. 6,915,964.

Figure 5:
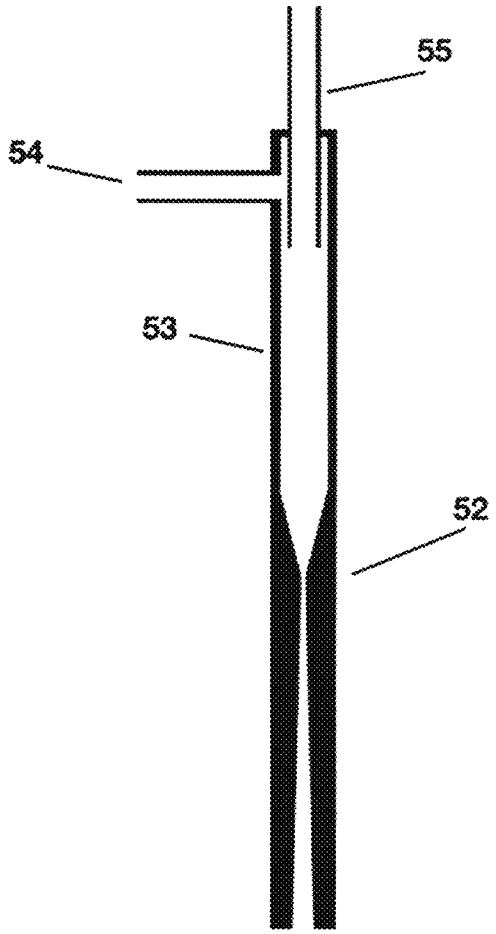
Fig. 5 PRIOR ART
FIG. 5 is a cross-sectional view of a known friction compensated nozzle applicator for use with the apparatus of FIG. 1.

FIG. 5 shows a cross-sectional view a friction compensated nozzle (52) applicator as disclosed in U.S. Pat. No. 6,915,964 attached to nozzle mixing chamber (53) that serves as a means for blending hot carrier gas injected into the inlet port (54) with a mixture of carrier gas and powder injected into powder inlet port (55). The mixture of carrier gas and powder is dispensed by the powder fluidizing unit (1) of this invention. Blending of a hot carrier gas (e.g., helium or nitrogen) heated by a conventional gas heater with the mixture of carrier gas and powder within the mixing chamber (53) enables heat treatment of the powder to thermally soften the powder particles prior to injection into the friction compensated nozzle (52) of deposition of the powder onto a substrate as a coating.

A further aspect of the invention permits a method of using the powder fluidizing unit (1) to dispense a mixture of a carrier gas blended with a reactive or passivating gas into the nozzle mixing chamber (53) where a chemical reaction induced by adding a hot carrier gas (helium or nitrogen) to the blend is promoted to film coat the powder particles prior to injection into the friction compensated nozzle (52) applicator. Such a method can be used to coat metallic and ceramic powder particles with a film of aluminum resulting from the thermal decomposition of organoaluminum precursor compounds including but not limited to dimethylethyl ethylenediamine dimethylaluminum, dimethylethyl ethylenediamine methylaluminum, trimethyl ethylenediamine dimethylaluminum, triethyl ethylenediamine dimethylaluminum, diethylmethyl ethylenediamine dimethylaluminum, dimethylpropyl ethylenediamine dimethylaluminum, and dimethylethyl ethylenediamine diisopropylaluminum.

Likewise, another aspect of the invention permits a process to film coat or passivate powders with polymer films prior to deposition with a friction compensated nozzle (52) applicator. For example, vapor phase polymers can be used to apply a polymer film to metallic, ceramic, and polymer powder particles using gaseous monomers such as ethylene (LDPE, HDPE), tetrafluoroethylene (PTFE), and vinyl chloride (PVC). propylene (PP), methyl methacrylate (PMMA), methyl acrylate (PMA), vinyl acetate (PVA), ethylene vinyl acetate (PEVA) and other types of polymers that are stable in the gaseous phase. The vapor phase monomers are injected into the powder fluidizing unit (1) with a carrier gas for conveying the powder particles and gaseous monomers to a nozzle mixing chamber (53), where a gaseous catalyst (e.g., Ziegler-Natta catalyst) is injected for initiating the polymerization process of polyethylene and polypropylene.

Maintaining polymeric monomers at gaseous temperature requires heating of the powder fluidizing unit (1) to temperatures in the range of 400-600 degrees F., which requires thermally isolating the motor 11 for rotating the brush 20 from the high temperature of a heated powder-fluidizing apparatus 1 and pressure vessel 2.

It should be noted that any or all of the aforementioned alternate embodiments may be used in any combination desired to form additional hybrid embodiments. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. Powder fluidizing apparatus comprising, a unitary pressure vessel having a powder compartment and a transfer compartment;

a lid coupled to a first open end of the powder compartment of the unitary pressure vessel;

a base coupled to a second end of the unitary pressure vessel, the second end sealing an open end of the transfer compartment;

a plate that separates the powder compartment from the transfer compartment, the plate being located between the lid and the base;

a coupling collar that secures a sieve disk packet in an opening in the plate; and a tube extending from the transfer compartment to the powder compartment, the tube extending to a location near the lid of the unitary pressure vessel;

whereby the transfer compartment can be pressurized with a carrier gas;

pressure in the transfer compartment and pressure in the powder compartment are equalized by the tube; and the unitary pressure vessel is configured to contain the carrier gas in both the powder compartment and the transfer compartment and simultaneously perform as a reservoir for holding a quantity of powder in the powder compartment.

2. The powder fluidizing apparatus of claim 1, comprising:

a brush in contact with the sieve disk packet, the brush feeding the powder from the powder compartment to the transfer compartment and breaking up agglomerated particles in the powder by sweeping the powder through openings in the sieve disk packet.

3. The powder fluidizing apparatus of claim 2, comprising:

a motor in the lid, a drive shaft operatively connecting the motor to the brush, and a coupling for adjusting the length of the drive shaft.

4. The powder fluidizing apparatus of claim 1, wherein the sieve disk packet is a wire cloth.

5. The powder fluidizing apparatus of claim 1, wherein the sieve disk packet is a perforated disk.

6. The powder fluidizing apparatus of claim 1, comprising a funnel located in the transfer compartment adjacent to the plate at a predetermined distance from the sieve disk packet, the funnel collecting powder after it is swept from the powder chamber through the openings in the sieve disk packet, the powder then dropping from the sieve disk packet through gravitational force.

7. The powder fluidizing apparatus of claim 6, comprising an electromechanical solenoid mounted in the base, the solenoid having an armature that induces a shock vibration into the funnel when pulsed, the shock reducing powder buildup on a surface of the funnel.

* * * * *